US012320080B2

(12) United States Patent
Menzenbach

(10) Patent No.: US 12,320,080 B2
(45) Date of Patent: Jun. 3, 2025

(54) CONSTRUCTION MACHINE

(71) Applicant: Wirtgen GmbH, Windhagen (DE)

(72) Inventor: Christoph Menzenbach, Neustadt (DE)

(73) Assignee: Wirtgen GmbH, Windhagen (DE)

( * ) Notice: Subject to any disclaimer, the term of this patent is extended or adjusted under 35 U.S.C. 154(b) by 194 days.

(21) Appl. No.: 18/065,785

(22) Filed: Dec. 14, 2022

(65) Prior Publication Data

US 2023/0203764 A1 Jun. 29, 2023

(30) Foreign Application Priority Data

Dec. 23, 2021 (DE) ..... 10 2021 134 623.1

(51) Int. Cl.
*E01C 23/088* (2006.01)

(52) U.S. Cl.
CPC ..... *E01C 23/088* (2013.01)

(58) Field of Classification Search
CPC ..... E01C 23/088; E01C 21/00; E01C 23/065
See application file for complete search history.

(56) References Cited

U.S. PATENT DOCUMENTS 5,190,398 A * 3/1993 Swisher, Jr. ..... B62D 33/0633 173/24
5,354,147 A 10/1994 Swisher, Jr.
9,605,393 B2 * 3/2017 Schlenker ..... E01C 21/00
2010/0284741 A1 * 11/2010 Vitale ..... C09K 3/22 252/88.1
2012/0128419 A1 * 5/2012 Menzenbach ..... E01C 23/065 404/90
2016/0024728 A1 * 1/2016 Menzenbach ..... E01C 23/088 299/10
2017/0138004 A1 5/2017 Berning et al.
2021/0310201 A1 * 10/2021 Doy ..... E01C 23/065
2021/0310202 A1 10/2021 Doy et al.
2021/0317621 A1 10/2021 Doy et al.

FOREIGN PATENT DOCUMENTS

DE 202008016935 U1 7/2010

OTHER PUBLICATIONS

European Search Report for corresponding patent application No. 22216360.2, dated May 25, 2023, 6 pages (not prior art).

* cited by examiner

*Primary Examiner* — Carib A Oquendo
(74) *Attorney, Agent, or Firm* — Lucian Wayne Beavers; Patterson Intellectual Property Law PC

(57) ABSTRACT

In a self-propelled construction machine (1), in particular recycling machine or stabilizing machine, for working a ground (20), comprising at least one machine frame, a working device (10) for working the ground, which is supported on the machine frame (2), wherein the working device is at least partially enclosed by a housing, wherein the housing comprises a plate each at the front and rear end as seen in the main direction of travel that closes off the mixing chamber of the housing towards the front and the rear, respectively, wherein the front plate is adjustable by means of at least one front adjustment device and the rear plate is adjustable by means of at least one rear adjustment device, wherein, in a first working operation, the rear plate as seen in the main direction of travel is supported on the ground in a floating position, it is provided that in a second working operation, the front plate as seen in the main direction of travel is supported on the ground in a floating position.

15 Claims, 4 Drawing Sheets

CONSTRUCTION MACHINE

CROSS-REFERENCES TO RELATED APPLICATIONS

This application claims the benefit of German Patent Application No. DE 10 2021 134 623.1 filed Dec. 23, 2021, which is hereby incorporated by reference.

BACKGROUND OF THE DISCLOSURE

Field of the Disclosure

The present invention relates to a self-propelled construction machine, as well as to a method for working the ground with a construction machine.

Description of the Prior Art

Construction machines, in particular recycling machines or stabilizing machines for working a ground, are known that comprise at least one machine frame and at least one working device for working the ground, wherein the working device is mounted on the machine frame and is at least partially enclosed by a housing. In this arrangement, the housing comprises a plate each at the front and rear end as seen in the main direction of travel that closes off the mixing chamber of the housing towards the front and the rear, wherein the front plate is adjustable by means of at least one front adjustment device and the rear plate is adjustable by means of at least one rear adjustment device. The rear plate as seen in the main direction of travel is supported on the ground in a floating position.

Such construction machines, in particular stabilizing machines or recycling machines, are used for the processing of materials, namely, for example, the stabilization of soils of insufficient load-bearing capacity, the pulverization of asphalt pavements and the recycling of bound or unbound pavement surfaces. For the improvement or stabilization of soils, it is known to introduce a binder into the soil in order to increase its suitability for placing and load-bearing capacity. The required processes such as, for example, binding and crushing of the milled-off pavement material, addition of binders, as well as mixing and distribution of added materials, are performed, in a fashion adapted to the specific application, in the mixing chamber located between the front and rear plate and the working device.

In the construction machines known to date, the rear plate as seen in the main direction of travel is supported on the ground in a floating position. The operator may adapt or adjust the contact pressure of the rear plate in the floating position on the ground by means of the rear adjustment device. If the contact pressure is too low, the material in the mixing chamber is not sufficiently mixed. If the contact pressure is too strong, the machine slows down. The engine may even be stalled.

Summary of the Disclosure

There is an increasing requirement to further improve the construction machine and the method for working the ground so as to ensure optimum mixing of the material.

The present invention advantageously provides that in a second working operation the front plate as seen in the main direction of travel is supported on the ground in a floating position.

The present invention has the advantage that in a further, namely, second working operation, the front plate may also be adjusted in such a fashion by means of the front adjustment device that it is supported on the ground in a floating position.

It is thus possible that even with a change of direction the material may be mixed to a consistent quality and even in reverse travel the material may be levelled off by means of the front plate as seen in the main direction of travel. Renewed positioning may thus also be avoided.

The construction machine is preferably moved in the main direction of travel in the first working operation.

The construction machine is preferably moved against the main direction of travel in the second working operation.

The main direction of travel may also be termed forward direction of travel, and the direction against the main direction of travel may also be termed reverse direction of travel.

During the first working operation, the front plate as seen in the main direction of travel may be in at least one predefined position, preferably lifted position.

During the second working operation, the rear plate as seen in the main direction of travel may be in at least one predefined position, preferably raised position.

The front plate as seen in the main direction of travel ensures during the first working operation, and the rear plate as seen in the main direction of travel ensures during the second working operation that the flow of material into the housing is possible.

In the respective floating position, a contact edge of the front plate or a contact edge of the rear plate, respectively, may be supported on the ground with a predetermined contact force.

With the previously predetermined contact force, it is possible to apply pressure to the ground by means of the front or rear plate and thus level off the ground material. The surface may thus be defined and also slightly pre-compacted if necessary.

The contact force with which the front or rear plate is supported on the ground in the respective floating position may be adjustable.

It is thus possible to adjust the force with which the front or rear plate is supported on the ground.

The control device may control the respective contact force of the respective supporting edge of the front or rear plate as a function of the working condition, in particular, the material and/or the milling depth.

As previously explained in connection with the state of the art, the contact force must be adjusted in such a fashion that the pressure applied to the ground by the plate is not too low as that will result in insufficient mixing. On the other hand, the contact force must also not be too high as that would cause the machine to slow down.

The appropriate contact force, which the operator preferably adjusts at the beginning of a work process in particular for the rear plate, may be determined by means of tests under different working conditions, so that values for specific working conditions are already known to the operator in advance.

Factors leading to different working conditions, which the amount of the contact force or also the amount of the open position of the plate are dependent upon, are, for example:

the material to be worked
the milling depth/working depth
the type of binder to be introduced
the amount of binder to be introduced
the operating speed/forward advance speed Particularly advantageously, such predetermined values may be stored in a storage unit assigned to a control unit. In this arrangement, the storage unit may be a part of the control unit or designed separately from the same. It may in particular be provided that proposed machine settings, in particular advantageous contact forces of the plate, are assigned to different working conditions in the storage unit in the form of a table. The machine operator may then set the machine to an appropriate configuration status by selecting a predetermined subsoil condition appropriate to the currently prevailing working conditions.

On the other hand, the operator may also determine the optimum contact force by trying and testing the material that is actually present.

Particularly advantageously, the operator may first preselect a machine configuration by choosing from subsoil conditions or working conditions, respectively, and then adapt these to the actual conditions during the operation.

The same applies to the appropriate position of the plates, in particular the front plate, preferably at the beginning of a work process. The position may be determined by means of tests under different working conditions, so that values for specific working conditions are already known to the operator in advance.

Factors leading to different working conditions, which the amount of the open position of the plate is dependent upon, are, for example:

the material to be worked the milling depth/working depth the type of binder to be introduced the amount of binder to be introduced the operating speed/forward advance speed Particularly advantageously, such predetermined values may be stored in the storage unit assigned to the control unit. In this arrangement, the storage unit may be a part of the control unit or designed separately from the same. It may in particular be provided that proposed machine settings, in particular advantageous positions of the plate, are assigned to different working conditions in the storage unit 40 in the form of a table. The machine operator may then set the machine to an appropriate configuration status by selecting a predetermined subsoil condition appropriate to the currently prevailing working conditions.

On the other hand, the operator may also determine the optimum position by trying and testing the material that is actually present.

Particularly advantageously, the operator may first preselect a machine configuration by choosing from subsoil conditions or working conditions, respectively, and then adapt these to the actual conditions during the operation.

According to the present invention, it is now possible that the construction machine may also be moved in the direction opposite to the main direction of travel, and that optimum mixing may take place in the process, since the front plate is also supported on the ground with a contact force in the respective floating position.

Alternatively, the contact force with which the respective supporting edge of the front or rear plate is supported on the ground in the respective floating position, may be adjustable in such a fashion that the contact force results from the own weight of the plate and an additional force that is applied to the respective plate by means of the front or rear adjustment device.

In the most simple case, said additional force may be zero so that the contact force with which the respective supporting edge of the front or rear plate is supported on the ground in the respective floating position, may result from the own weight of the plate.

On the other hand, an additional force may act in the direction of the ground or in the opposite direction.

This means that the contact force with which the supporting edge of the respective plate is supported on the ground is either supported on the ground with a higher force than that of the own weight, or also with a lower force, since the additional force acts either in the same direction as the own weight of the plate, or in the opposite direction.

The contact force with which the respective supporting edge of the front or rear plate is supported on the ground may thus be optimally adjusted.

The contact force of the respective supporting edge of the front or rear plate may be continuously adjustable by means of the front and/or the rear adjustment device.

The front and/or rear adjustment device may preferably be a hydraulic adjustment device.

When switching from the first working operation to the second working operation, the control device may adjust the contact force of the contact edge of the front plate by means of the front adjustment device in such a fashion that it essentially corresponds to the contact force of the contact edge of the rear plate prior to switching.

This has an advantage for the operator in that, when changing the direction of travel, he does not have to make an additional adjustment of the contact force.

In this arrangement, the control device may also take into account different geometries of the suspension of the plates and/or different adjustment devices and/or different articulation points of the adjustment devices on the plates. The decisive factor is that the contact forces of the supporting edges on the ground are identical. The difference in the own weight of the front and rear plate may also play a role in the actual force of the front adjustment device being adjusted differently from the force of the rear adjustment device.

When switching back from the second working operation to the first working operation, the control device may adjust the contact force of the rear plate by means of the rear adjustment device in such a fashion that it essentially corresponds to the contact force of the front plate prior to switching.

Alternatively, the control device may draw on previously stored values for the contact force of the contact edge of the rear plate that have already been used in the previous first working operation.

When switching from the first working operation to the second working operation, the control device may adjust the position of the rear plate in such a fashion that it corresponds to the predetermined position of the front plate prior to switching.

According to the present invention, a method for working a ground with a construction machine may be provided comprising the following steps:

a. working the ground with a working device of the construction machine that is at least partially enclosed by a housing, wherein the housing comprises a plate each at the front and rear end of the construction machine as seen in the main direction of travel that closes off the mixing chamber of the housing towards the front and the rear, respectively, wherein the front plate and the rear plate may be adjusted, b. mixing the mix in a mixing chamber enclosed by the housing while working the ground, c. adjusting a first working operation in which the rear plate is supported on the ground in floating position.

According to the present invention, it may be advantageously provided that a second working operation is adjustable in which the front plate is supported on the ground in floating position.

In the respective floating position, a supporting edge of the front plate or rear plate, respectively, may each be supported on the ground with a predetermined contact force.

The contact force with which the supporting edge of the front or rear plate is supported on the ground in the respective floating position may be adjusted.

When switching from the first working operation to the second working operation, the contact force of the contact edge of the front plate may be adjusted in such a fashion that it essentially corresponds to the contact force of the contact edge of the rear plate prior to switching.

The contact force with which the supporting edge of the front or rear plate is supported on the ground in the respective floating position, may be adjusted in such a fashion that the contact force results from the own weight of the plate and an additional force that is additionally applied to the respective plate.

The additional force may act in the direction of the force of the own weight or in the opposite direction.

Furthermore, the additional force may also be zero. The contact force with which the supporting edge of the front or rear plate is supported on the ground in the respective floating position thus results from the respective own weight of the plates.

BRIEF DESCRIPTION OF THE DRAWINGS

In the following, embodiments of the invention are explained in more detail with reference to the drawings.

The following is shown schematically.

DETAILED DESCRIPTION

Figure 1:
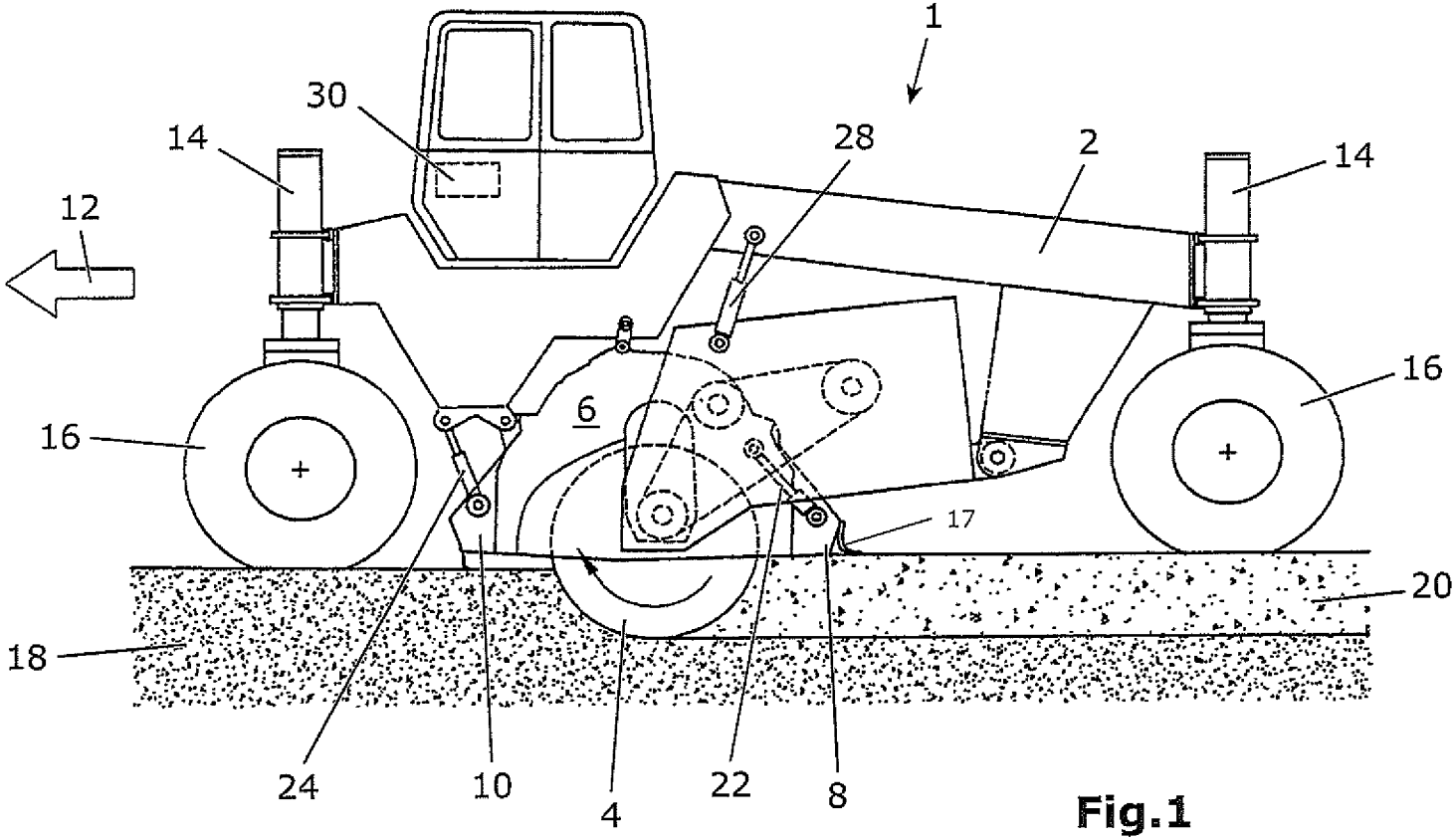
FIG. 1 a side view of the construction machine according to the present invention, FIG. 2 a simplified side view of the construction machine according to the present invention, FIG. 3 the construction machine according to FIG. 2 with previously worked ground material, and FIG. 4 the construction machine in a direction of travel opposite to the main direction of travel.

FIG. 1 shows a self-propelled construction machine 1 for working a ground 18, 20. The illustrated construction machine 1 is a stabilizing machine or recycling machine. The construction machine 1 comprises a machine frame 2. A working device 4 for working the ground 18, 20 is mounted on the machine frame 2. The working device 4 may be a milling drum, as in the illustrated embodiment. The working device 4 is at least partially enclosed by a housing 6.

In the illustrated embodiment, the housing 6, and therefore also the working device 4, may be adjusted in height relative to the machine frame 2 by means of a lifting device 28. Alternatively, the housing 6, and therefore the working device 4, may also be directly mounted on the machine frame 2 without being adjustable in height relative to the same.

Lifting columns 14 are arranged on the machine frame 2, and travelling devices 16 are connected to the lifting columns 14. Said travelling devices 16 may be wheels or also tracked ground-engaging units. The lifting columns 14 may be adjusted in height, thus enabling the machine frame to be adjusted in height relative to the ground 18, 20. Since the working device 4 is connected to the machine frame 2, the height of the working device 4 relative to the ground 18, 20 may therefore also be adjustable by means of an adjustment of the lifting columns 14.

In the present embodiment, the working device 4 may therefore be adjustable in height both relative to the machine frame 2 and, together with the machine frame 2 by means of the lifting device 14, relative to the ground 18, 20.

Embodiments are also possible, however, in which the working device 4 may only be adjustable in height relative to the machine frame 2, or may only be adjustable in height together with the machine frame 2 by means of the lifting device 14.

The housing 6 comprises a front plate 10 and a rear plate 8, respectively, at the front and rear end as seen in the main direction of travel 12, which close off the mixing chamber of the housing 6 towards the front and the rear.

The front plate 10 may be adjustable, in particular adjustable in height, by means of a front adjustment device 24, and the rear plate 8 may be adjustable, in particular adjustable in height, by means of a rear adjustment device 22. The front adjustment device 24 may be referred to as a front adjustment actuator 24, and the rear adjustment device 22 may be referred to as a rear adjustment actuator 22. In this arrangement, the plates may pivot, for example, or may also be guided along a guide. As shown in the illustrated embodiment according to FIG. 1, but not absolutely necessary, additional rubber lips 17 are also provided for sealing and closing off relative to the milled ground 20, or for levelling off the milled ground 20.

The illustrated construction machine 1 may be, for example, a stabilizing machine or recycling machine. For the stabilization of soils of insufficient loadbearing capacity, the ground may be milled with the working device 4, which may be a milling and mixing rotor. The ground material then accumulates in the mixing chamber 7 (FIG. 2), which is surrounded by the housing 6, where binders such as, for example, cement slurry may then be added, and the rear plate 8 may then level off the material.

With a recycling machine, damaged asphalt layers may be milled and crushed, for example, and the milled-off and crushed ground material may then be mixed in the mixing chamber, which is surrounded by the housing 6, and binder such as, for example, foamed bitumen may be added, and the rear plate 8 may then level off the material 20. The material 20 may also be termed milled ground 20.

Figure 2:
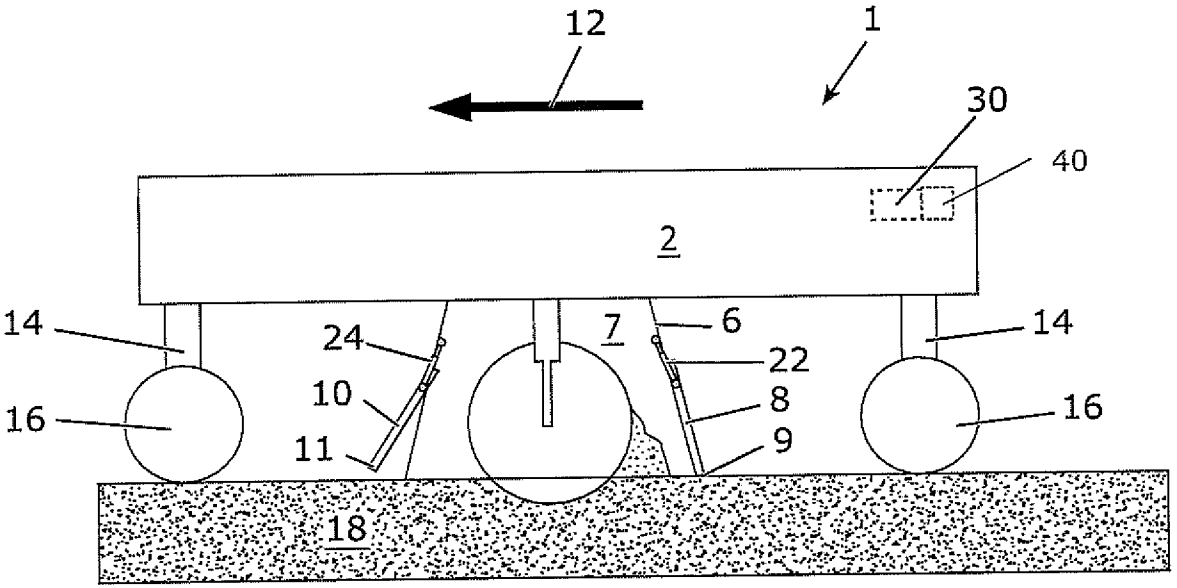
Figure 3:
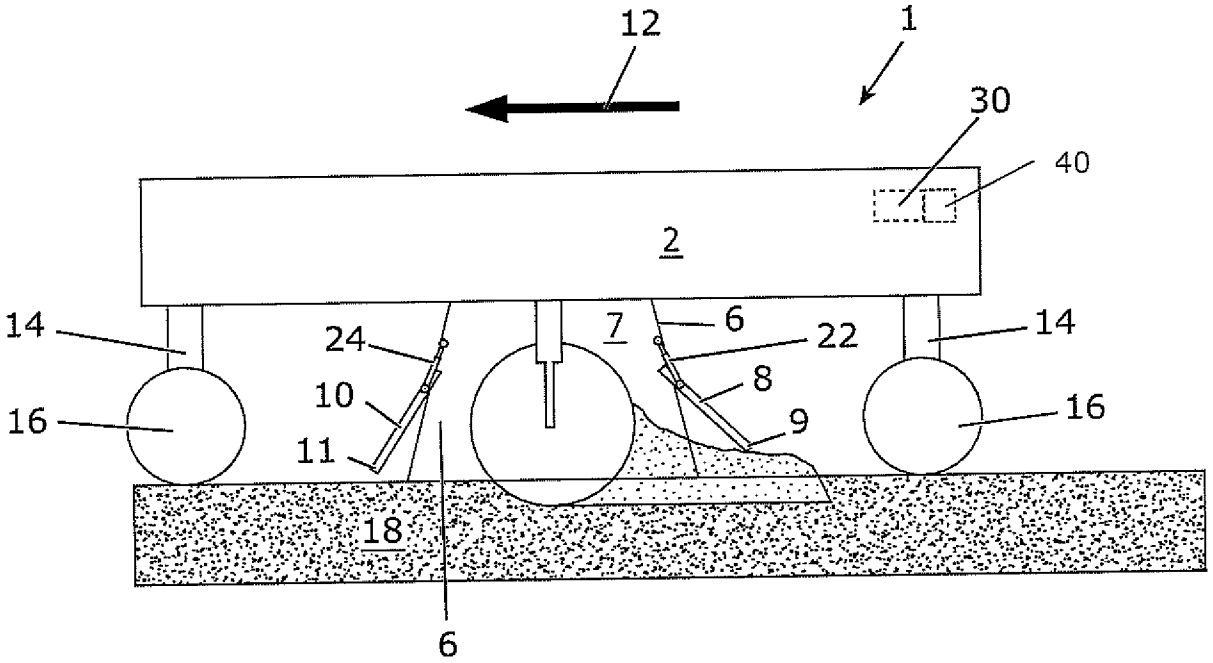
Figure 4:
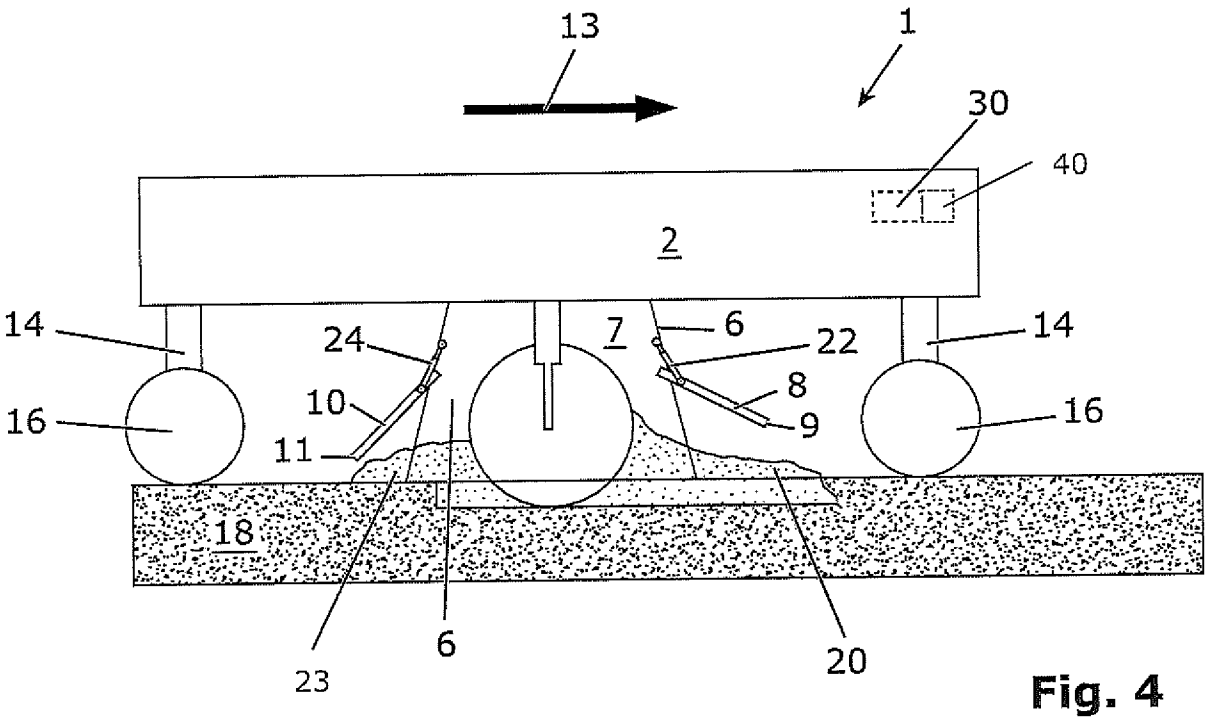

The individual steps of mixing and levelling off are explained in more detail in the schematic FIGS. 2 to 4.

FIG. 2 shows merely a schematic illustration of the construction machine 1. The working device 4 is shown in lowered position and is in the first working operation and moves in the main direction of travel 12. The working device 4 mills the ground 18 and the milled material accumulates in the mixing chamber 7, which is surrounded by the housing 6. Binding agents may be added in the mixing chamber 7.

The front plate 10 is moved into a predefined position during the first working operation. The predefined position is preferably a raised position. The raised position may be described as a raised position above the ground 18. The raised position allows the flow of material into the housing 6. The supporting edge 9 of the rear plate 8 is supported on the ground 18 in floating position in the first working operation. In floating position means that the supporting edge 9 is supported on the ground 18, 20 with a predetermined contact force. The floating position of the rear plate 8 may also be described as a floating mode of the rear plate 8.

The contact force with which the supporting edge 9 of the rear plate 8 is supported on the ground 18 in the floating position may be adjusted by means of a control device 30. The control device 30 may also be referred to as a controller 30. The control device 30 controls the contact force of the supporting edge 9 of the rear plate 8 as a function of the material that is mixed in the mixing chamber 7. Depending on the strength of the material, the contact force must be adapted accordingly. In doing so, it should be ensured that the rear plate is not raised too far and, consequently, the contact force is too low, since this will not allow sufficient mixing of the material in the mixing chamber 7. On the other hand, the rear plate should not be lowered too far and, consequently, the contact force be too high, since the construction machine 1 will otherwise be slowed down and, in the worst case, the engine will be stalled due to the excessively high load.

The appropriate contact force may be determined by means of tests under different working conditions, so that values for specific working conditions are already known to the operator in advance.

Factors leading to different working conditions, which the amount of the contact force or also the amount of the open position of the plate are dependent upon, are, for example:

the material to be worked
the milling depth/working depth
the type of binder to be introduced
the amount of binder to be introduced
the operating speed/forward advance speed Particularly advantageously, such predetermined values may be stored in a storage unit 40 assigned to the control unit 30. In this arrangement, the storage unit 40 may be a part of the control unit 30 or designed separately from the same. It may in particular be provided that proposed machine settings, in particular advantageous contact forces of the plate, are assigned to different working conditions in the storage unit 40 in the form of a table. The machine operator may then set the machine to an appropriate configuration status by selecting a predetermined subsoil condition appropriate to the currently prevailing working conditions.

On the other hand, the operator may also determine the optimum contact force by trying and testing the material that is actually present.

Particularly advantageously, the operator may first preselect a machine configuration by choosing from subsoil conditions or working conditions, respectively, and then adapt these to the actual conditions during the operation.

In FIG. 3, the construction machine 1 has moved forward relative to the position illustrated in FIG. 2. The ground material has been mixed and the mixed material 20, to which binder has been added, is discharged again. The rear plate 8 levels off the material so that a desired height of the material is created.

Since the material exhibits a higher volume due to mixing, and the volume is also higher due to the addition of the additional binder, the worked ground 20, as illustrated in FIG. 3, is usually higher than the previous, non-worked ground 18.

The contact force with which the supporting edge 9 of the rear plate 8 is supported on the ground 18, 20 in the floating position, may be adjustable in such a fashion that the contact force results from the own weight of the rear plate 8 and an additional force that is applied to the plate 8 by means of the rear adjustment device 22.

The force that is applied to the rear plate 8 by means of the adjustment device 22 may act in the direction of the ground so that the force of the own weight is further increased. Alternatively, the force may also act in the opposite direction away from the ground 18, 20 so that the force of the own weight, which normally acts on the ground 18, 20, is reduced and the total contact force is therefore lower than the force of the own weight. The contact force may thus be optimally adapted to the requirements.

The rear adjustment device 22 is preferably a hydraulic adjustment device and may therefore continuously adjust the contact force. Alternatively, other adjustment devices are also possible.

The front plate 10 may be adjusted to different positions depending on the amount of material that is to enter the mixing chamber 7. The positions may preferably be adjustable in increments.

The appropriate position of the front plate 10 may be determined by means of tests under different working conditions, so that values for specific working conditions are already known to the operator in advance.

Factors leading to different working conditions, which the amount of the open position of the plate is dependent upon, are, for example:

the material to be worked
the milling depth/working depth
the type of binder to be introduced
the amount of binder to be introduced
the operating speed/forward advance speed Particularly advantageously, such predetermined values may be stored in the storage unit 40 assigned to the control unit 30. In this arrangement, the storage unit 40 may be a part of the control unit 30 or designed separately from the same. It may in particular be provided that proposed machine settings, in particular advantageous positions of the plate, are assigned to different working conditions in the storage unit 40 in the form of a table. The machine operator may then set the machine to an appropriate configuration status by selecting a predetermined subsoil condition appropriate to the currently prevailing working conditions.

On the other hand, the operator may also determine the optimum position by trying and testing the material that is actually present.

Particularly advantageously, the operator may first preselect a machine configuration by choosing from subsoil conditions or working conditions, respectively, and then adapt these to the actual conditions during the operation.

The front plate 10 may preferably be moved into said predefined position by means of the front adjustment device 24.

A second working operation is illustrated in FIG. 4. The construction machine 1 moves in the direction 13 opposite to the main direction of travel 12. In the second working operation, the front plate 10 as seen in the main direction of travel 12 is supported on the ground 18, 20 in a floating position. The floating position of the front plate 10 may also be described as a floating mode of the front plate 10.

When switching from the first working operation to the second working operation, the control device 30 adjusts the contact force of the contact edge 11 of the front plate 10 by means of the front adjustment device 24 in such a fashion that it essentially corresponds to the contact force of the contact edge 9 of the rear plate 8 prior to switching. This has the advantage for the operator that, when driving opposite to the main direction of travel 12, namely, in reverse direction, he does not have to make a readjustment of the contact force.

When switching, the contact force previously read out from the storage unit 40 at the beginning of the work process and used for the rear plate 8 may therefore also be used for the front plate 10. Alternatively, the value actually adjusted at the rear plate 8 may particularly preferably be used. The value actually adjusted is, in particular, the value read out at the beginning of the work process and used for the rear plate 8, but which has been adapted by the operator during the operation.

The rear plate 8 is moved into a predetermined position during the second working operation, which is preferably a raised position. Since the construction machine 1 now moves in the direction 13, the flow of material into the housing 6 takes place in the area of the rear plate 8. The material 23 is levelled off by the front plate 10.

Exactly as has already been described with regard to the first working operation, the ground 18 is milled by means of the working device 4. The material accumulates in the mixing chamber 7, which is enclosed by the housing 6. Binder is added and the material 23 is discharged again, wherein the material is levelled off by the front plate 10 supported on the ground 18 in floating position. Also in the second working operation, it is decisive that the contact force is not too high and not too low.

As a result of the present invention, the contact force of the supporting edge 11 corresponds to the contact force of the supporting edge 9, and thus a consistent work result is possible without the need for additional adaptations. However, due to the possibility of changing conditions, the contact force may still be adapted by the machine operator during the further operation.

In this arrangement, the control device 20 also takes into account different geometries of the suspension and different adjustment devices. FIG. 1 illustrates, for example, how differently the adjustment devices 22 and 24 may be suspended. The decisive factor is that the contact force of the supporting edge on the ground is identical. The difference in the own weight of the front and rear plate may also play a role in the actual force of the adjustment device 24 being adjusted differently from the force of the adjustment device 22.

In addition, when switching from the first working operation to the second working operation, the control device 30 may adjust the position of the rear plate 8 in such a fashion that it corresponds to the predetermined position of the front plate 10 prior to switching. The different geometries of the plates or also different suspensions may also be taken into account.

When switching back from the second working operation to the first working operation, the control device 30 may adjust the contact force of the rear plate 8 by means of the rear adjustment device 22 in such a fashion that it essentially corresponds to the contact force of the front plate 10 prior to switching. Alternatively, it would also be possible that, in the control device, the previous values of the first working operation are stored in the storage unit 40 and the same are simply adopted again when switching back to the first working operation.

As a basic principle, the values of the first and second working operation may be stored in the storage device 40 so that the operator may select the same again in accordance with requirements.

The control device 30 may be integrated into the machine control system or may be arranged separately from the same.

The invention claimed is:

1. A self-propelled construction machine for working a ground, comprising:

a machine frame;

a mixing and milling drum supported from the machine frame for working the ground;

a housing at least partially enclosing the mixing and milling drum, the housing defining a mixing chamber and including a front plate for closing off the mixing chamber at a front end of the housing relative to a main direction of travel, and a rear plate for closing off the mixing chamber at a rear end of the housing relative to the main direction of travel;

at least one rear adjustment actuator for adjusting a position of the rear plate, the rear adjustment actuator being configured such that in a first working operation wherein the machine is moving forward in the main direction of travel the rear plate is supportable on the ground in a floating mode;

at least one front adjustment actuator for adjusting a position of the front plate, the front adjustment actuator being configured such that in a second working operation wherein the machine is moving rearward the front plate is supportable on the ground in a floating model, wherein the front and rear adjustment actuators are configured such that in respective floating modes of the front and rear plates a supporting edge of the front or rear plate, respectively, is supported on the ground with a predetermined contact force; and a controller operably associated with the front and rear adjustment actuators, the controller being configured to control the predetermined contact force with which the respective supporting edge of the front or rear plate is supported on the ground in the respective floating mode.

2. The self-propelled construction machine of claim 1, wherein:

the front adjustment actuator and the controller are configured such that during the first working operation the front plate is held in a raised position above the ground.

3. The self-propelled construction machine of claim 1, wherein:

the rear adjustment actuator and the controller are configured such that during the second working operation the rear plate is held in a raised position above the ground.

4. The self-propelled construction machine of claim 1, wherein:

the front and rear adjustment actuators are configured such that the positions of the front and rear plates, respectively, are adjustable in increments.

5. The self-propelled construction machine of claim 1, wherein:

the controller is further configured such that the controller controls the respective predetermined contact force of the respective supporting edge of the front or rear plate as a function of a material of the ground.

6. The self-propelled construction machine of claim 1, wherein:

the controller is further configured such that the controller controls the respective predetermined contact force of the respective supporting edge of the front or rear plate such that the predetermined contact force results from an own weight of the respective front or rear plate and an additional force that is applied to the respective plate by the front or rear adjustment actuator.

7. The self-propelled construction machine of claim 6, wherein:

the additional force acts in a direction of the ground or in an opposite direction from the ground.

8. The self-propelled construction machine of claim 1, wherein:

the front and rear adjustment actuators are hydraulic adjustment actuators and the predetermined contact force with which the respective supporting edge of the front or rear plate is supported on the ground in the respective floating mode is continuously adjustable.

9. The self-propelled construction machine of claim 1, wherein:

the controller is further configured such that when switching from the first working operation to the second working operation, the controller adjusts the predetermined contact force of the contact edge of the front plate with the front adjustment actuator such that the predetermined contact force of the contact edge of the front plate in the second working operation corresponds to the predetermined contact force of the contact edge of the rear plate prior to switching.

10. The self-propelled construction machine of claim 1, wherein:

the controller is further configured such that when switching from the first working operation to the second working operation, the controller adjusts the position of the rear plate with the rear adjustment actuator such that the position of the rear plate in the second working operation corresponds to the position of the front plate prior to switching.

11. A method of working a ground with a construction machine, the method comprising:

working the ground with a milling and mixing roller of the construction machine, the milling and mixing roller being at least partially enclosed by a housing, the housing including a front plate and a rear plate at a front end and a rear end, respectively, of the housing as seen in a main direction of travel, the front and rear plates closing off a mixing chamber of the housing towards the front end and rear end, respectively, of the housing, the plates being adjustable;

mixing the ground in the mixing chamber enclosed by the housing while working the ground;

during a first working operation in which the machine is moving forward in the main direction of travel, adjusting the rear plate such that the rear plate is supported on the ground in a floating mode; and during a second working operation in which the machine is moving rearward, adjusting the front plate such that the front plate is supported on the ground in a floating mode.

12. The method of claim 11, further comprising:

in the floating modes of either of the front plate or the rear plate, supporting a supporting edge of the front plate or the rear plate, respectively, on the ground with a predetermined contact force.

13. The method of claim 12, further comprising:

adjusting the predetermined contact force.

14. The method of claim 13, further comprising:

when switching from the first working operation to the second working operation, adjusting the predetermined contact force of the supporting edge of the front plate such that the predetermined contact force of the supporting edge of the front plate corresponds to the predetermined contact force of the supporting edge of the rear plate prior to switching.

15. The method of claim 11, further comprising:

controlling with an automatic controller the respective predetermined contact force of a respective supporting edge of the front or rear plate as a function of a material of the ground.

* * * * *